United States Patent [19]

Nishimura et al.

[11] Patent Number: 5,050,811

[45] Date of Patent: Sep. 24, 1991

[54] METHOD AND APPARATUS FOR PROCESSING YARN END OF PACKAGE

[75] Inventors: Yoshihiro Nishimura, Kaga; Noboru Sekitani, Ohtsu, both of Japan

[73] Assignee: Murata Kikai Kabushiki Kaisha, Kyoto, Japan

[21] Appl. No.: 380,875

[22] Filed: Jul. 17, 1989

[30] Foreign Application Priority Data

| | | | |
|---|---|---|---|
| Jul. 20, 1988 | [JP] | Japan | 63-179088 |
| Dec. 19, 1988 | [JP] | Japan | 63-318585 |
| Dec. 19, 1988 | [JP] | Japan | 63-318586 |
| Dec. 24, 1988 | [JP] | Japan | 63-324816 |

[51] Int. Cl.[5] ..... B65H 54/00; B65H 65/00

[52] U.S. Cl. ..... 242/18 R; 242/18 EW; 242/35.6 E

[58] Field of Search ..... 242/18 R, 18 EW, 35.5 R, 242/35.5 A, 35.6 R, 35.6 E

[56] References Cited

U.S. PATENT DOCUMENTS

| | | | |
|---|---|---|---|
| 4,138,072 | 2/1979 | Aoyama et al. | 242/18 EW X |
| 4,601,434 | 7/1986 | Mori et al. | 242/35.5 A |
| 4,616,789 | 10/1986 | Matsui et al. | 242/35.5 A X |
| 4,619,416 | 10/1986 | Matsui et al. | 242/35.5 A X |
| 4,630,782 | 12/1986 | Rohner | 242/18 R X |
| 4,634,065 | 1/1987 | Kupper et al. | 242/18 R |
| 4,723,720 | 2/1988 | Matsui et al. | 242/18 R |
| 4,736,898 | 4/1988 | Raasch et al. | 242/18 EW |
| 4,760,969 | 8/1988 | Otoshima et al. | 242/18 R |
| 4,842,206 | 6/1989 | Kawasaki et al. | 242/18 R |
| 4,848,077 | 7/1989 | Kawarabashi et al. | 242/35.6 E X |
| 4,901,931 | 2/1990 | Mista | 242/35.6 E X |
| 4,909,451 | 3/1990 | Kuepper et al. | 242/18 EW |
| 4,911,371 | 3/1990 | Mista | 242/35.6 E |

*Primary Examiner*—Stanley N. Gilreath

*Attorney, Agent, or Firm*—Spensley Horn Jubas & Lubitz

[57] ABSTRACT

According to the method of the present invention, when the package is supplied to the winder while being fitted on the tray, a yarn end released from the package is processed to be positioned at substantially central portion of one end face of the package from which the yarn is drawn, and then the package is fed at the predetermined winding position of the winder. The yarn end which is positioned at the central portion of the end face of the package may be wound around the extremity end of a peg of the tray or a head part of a take-up tube of the package by several times and the such processed package is fed to a rewinding step.

10 Claims, 9 Drawing Sheets

METHOD AND APPARATUS FOR PROCESSING YARN END OF PACKAGE

FIELD OF THE INVENTION

This invention relates to a method and an apparatus for processing a yarn end of a package, more particularly a method and an apparatus for processing the yarn end of the package when the package doffed by a spinning frame is transported to the winder.

RELATED ART STATEMENT

In general, a spinning bobbin upon finishing of spinning is doffed as a so-called spinning bobbin and then supplied to a winder where a rewinding operation is carried out. A spun yarn produced by a ring spinning frame is wound around a bobbin and doffed and a spun yarn produced by a rotor open-end spinning frame or a pneumatic spinning frame utilizing air swirling current and the like is wound around the package and doffed. This package has a large amount of yarn and is called a large package, wherein a diameter of the package is from several times to ten times of a diameter of the bobbin finished at the ring spinning frame.

FIG. 5 illustrates a state where the large package 2 is rewound on a winder 1. This package 2 has one type called as a cheese package 2*a* shown in FIG. 6, and another type called as a cone package 2*b* shown in FIG. 7.

As shown in FIGS. 8 and 9, these bobbins 3 or packages 2 have winding yarn end Y found when they are supplied to the winder 1 and rewound while being inserted into the tray 4. The yarn end of the bobbin 3 is processed such that a bunch winding (not shown) formed at an upper end part is released before it is supplied to the winder 1 and as shown in FIG. 8, it is transported while being inserted into the tray 4 under a state in which it is inserted from the upper end of the take-up tube 5 of the bobbin 3 into its inside part. The yarn end Y inserted into the take-up tube 5 is blown up by air fed from below the central hole 6 formed at the tray 4, sucked into a suction mouth 7 and then taken out.

As regards a yarn end finding of the yarn end Y of the package 2, since a diameter of the package 2 is so large that the yarn is relatively unwound due to a tapered cone package 2*b*. However, in case of the cheese package 2*a*, an unwinding resistance becomes large as compared with that of the corn package 2*b*, resulting in that its unwinding operation becomes difficult to do. Due to this fact, as the yarn end Y is blown up, the yarn end Y is displaced from an air flow at the central hole 6 of the tray 4 and so the yarn end finding can not be performed in the same manner as that of the bobbin 3.

So, at present, the yarn end Y of the package 2 is delivered to a suction mouth 7 and found by a method wherein as shown in FIG. 9 a metallic yarn guide 8 is fixed to an extremity end of a holder device for the yarn end so as to improve an inertia force as disclosed in Jap. Pat. Laid-Open No. 59-223667, the yarn guide is inserted into the central hole 6 of the peg 9 and then it is sucked as a blowing arrow with air fed from a lower part of the central hole 6 passing through the tray 4. However, the operation for fixing the yarn guide 8 to the yarn end Y is still manually performed, there is a certain problem in releasing the yarn engaged with the extremity end of the yarn guide 8 and so it sometimes shows an erroneous deliverying of the yarn to the suction pipe 7.

OBJECT AND SUMMARY OF THE INVENTION

It is an object of the present invention to provide a method and an apparatus for processing a yarn end of a package in which the yarn end of the package can be found automatically at a winder in the same manner as that of the spinning bobbin.

According to the method of an embodiment of the present invention, when the package is supplied to the winder while being fitted on the tray, a yarn end released from the package is processed to be positioned at substantially central portion of one end face of the package from which the yarn is drawn, and then the package is fed at the predetermined winding position of the winder. The yarn end which is positioned at the central portion of the end face of the package may be wound around the extremity end of a peg of the tray or a head part of a take-up tube of the package by several times and the such processed package is fed to a re-winding step.

According to an embodiment of the present invention, some devices for processing the yarn end of the package, which include a device for drawing out a yarn end of a yarn supply package, a yarn guide means, a yarn end clamp means, and the like, are provided so that the yarn end of the package is so processed as described above by the method of the above-described embodiment of the present invention.

DETAILED DESCRIPTION OF PREFERRED EMBODIMENTS

Figure 1:
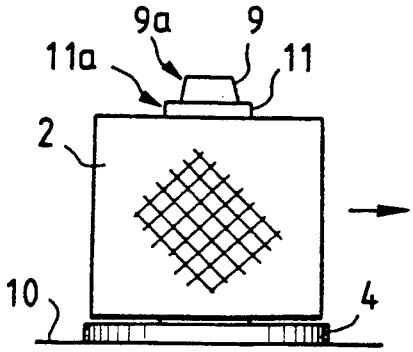
FIGS. 1 to 4 are schematic illustrations for showing a method for processing a yarn end of a package of an embodiment of the present invention.

Referring now to the drawings, one preferred embodiment of the present invention of a method for processing a yarn end of the package will be described in detail.

Figure 2:
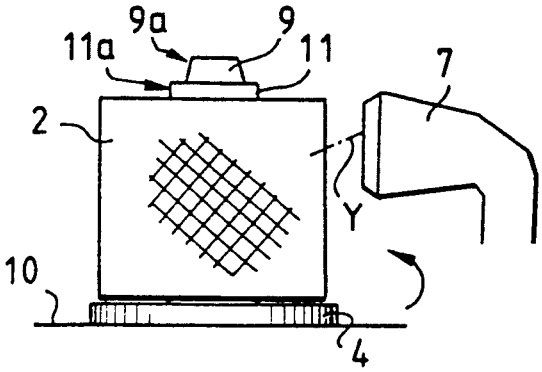
Figure 3:
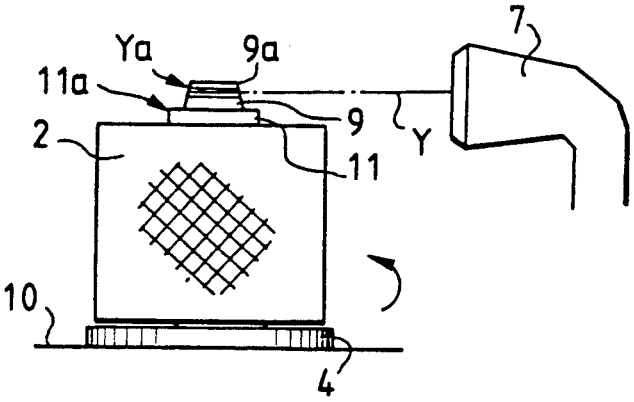
Figure 4:
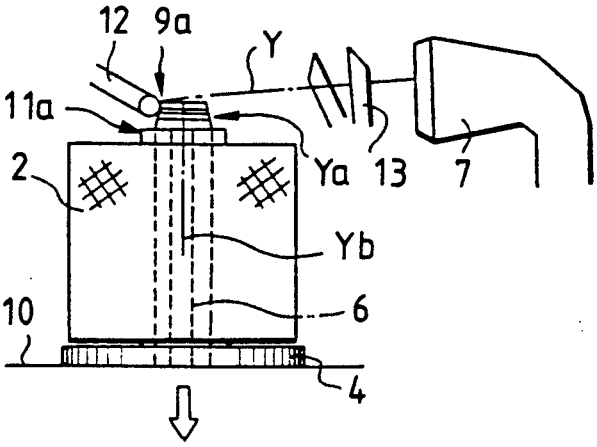
Figure 7:
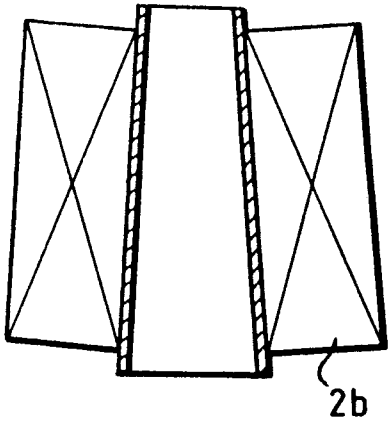
FIG. 7 PRIOR ART
FIG. 7 is a side elevational view in section for showing a cone package.
Figure 6:
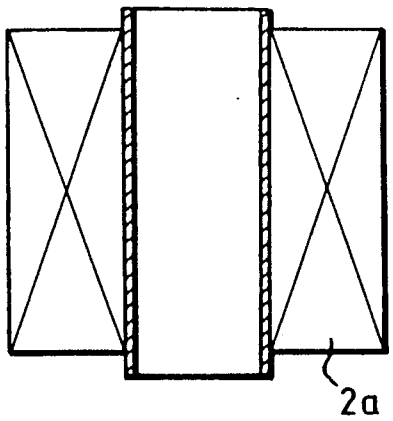
FIG. 6 PRIOR ART
FIG. 6 is a side elevational view in section for showing a cheese package.
Figure 5:
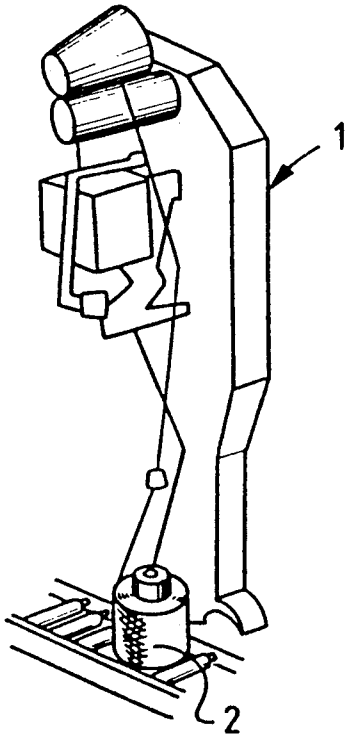
FIG. 5 PRIOR ART
FIG. 5 is a perspective view for showing a winder.
Figure 9:
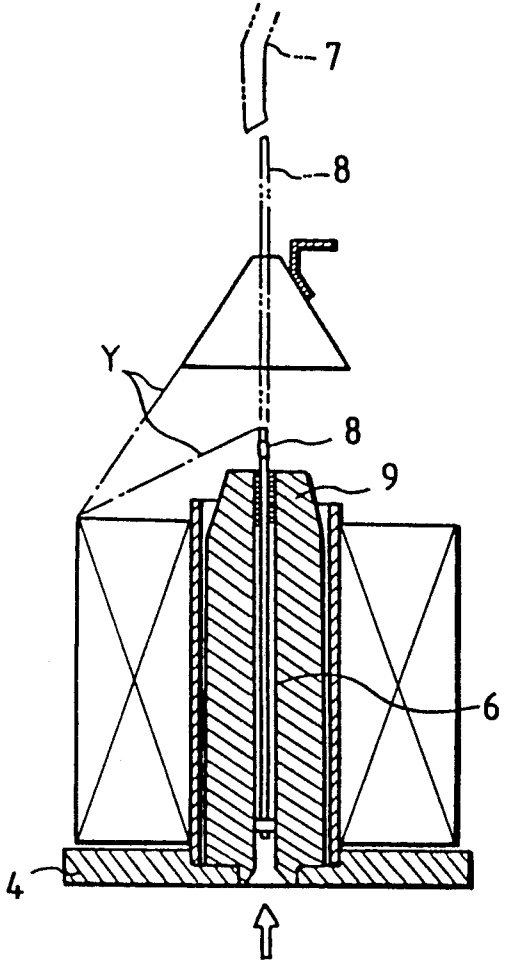
FIG. 9 PRIOR ART
FIG. 9 is a side elevational view in section for showing a state of blowing of a yarn end of the prior art package.
Figure 8:
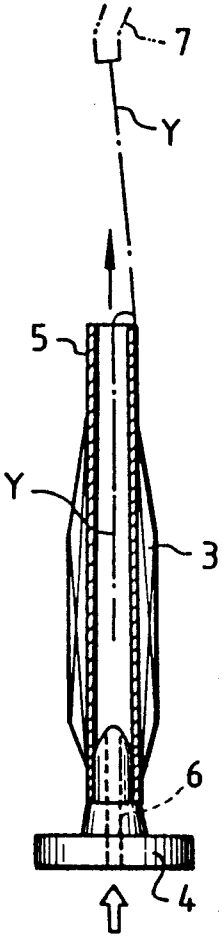
FIG. 8 PRIOR ART
FIG. 8 is a side elevational view in section for showing a state of blowing out a yarn end of the prior art spinning bobbin.

As shown in FIG. 1, the completed package 2 of the spinning frame (not shown) is transported through a transporting passage 10 to the winder (not shown) while being inserted and carried on the tray 4. In case of supplying of bobbin to the winder, as shown in FIG. 2, the yarn end Y is searched with a suction mouth 7 and found out while the tray 4 being rotated. This operation may be carried out by rotating the take-up tube 11 of the package 2 as the package 2 is rotated. Then, as shown in FIG. 3, the suction mouth 7 is moved upwardly, and the tray 4 is rotated and the yarn end Y of the package 2 is wound around the extremity end 9*a* of the peg by several times. Also in this case, if the package 2 is rotated, it may also be carried out by rotating the take-up tube 11 for the package 2. In this way, the winding of the yarn end Y of the package 2 around the extremity end 9*a* of the peg by several times corresponds to the case in which the peg 9 is projected from the take-up tube 11 for the package 2, and in case that the peg 9 is not projected from the take-up tube 11 of the package 2, the yarn is wound around the head part 11*a* of the take-up tube by several times. After the yarn end Y is wound around the extremity end 9*a* of the peg or the head 11*a* of the take-up tube by several times, the wound part Ya is supported by a unwinding prohibiting guide 12, the suction pipe 7 is ascended to cause the yarn end Y to be positioned just above the peg 9 or the take-up tube 11. Then, a part between the suction mouth 7 and the winding part Ya is cut by a cutter 13. The tray 4 and the peg 9 fixed on the tray are formed with a central hole 6 passing through in the same manner as that of the prior art. The inside part of central hole 6 is sucked from below the transporting passage 10 and then the cut extremity end of the yarn end Yb is sucked and inserted into the central hole 6 of the peg 9. When the peg 9 is not projected out of the take-up tube 11 for the package 2, the cut extremity end Yb of the yarn end is sucked into the central hole 6 of the peg 9 and take-up tube 11.

An action of the above-mentioned embodiment will be described.

As described above, as the yarn supplying package 2 of which yarn end Y is already processed is supplied to a predetermined rewinding position of the winder, the yarn end Y for joining with the yarn end of the winding package of the winding unit is drawn. As the extremity end Yb of the yarn end of the package inserted into the central hole 6 of the peg 9, the winding part Ya formed at the extremity end 9*a* of the peg is gradually unwound as the extremity end Yb of the yarn end is blown up and then the winding part is blown up. Similarly, as the extremity end Yb of the yarn end of the package 2 inserted into the bobbin 11 is blown up with air from below the central hole 6 of the peg 9, the winding part Ya formed at the head part 11*a* of the bobbin is gradually unwound together with the blowing-up of the extremity end Yb of the yarn end and blown up. In this way, after the yarn end Y is wound around the extremity end 9*a* of the peg or the head part 11*a* of the bobbin by several times, its extremity end Yb is inserted into the central hole 6 of the peg 9 or the take-up tube 11, thereby even if a winding diameter of the package 2 is large, the yarn end Y is processed near the central hole 6. Accordingly, even if the package 2 has a large winding diameter, the package occupies an approximate similar processing position of the yarn end Y as the processing position of a yarn end of a spinning bobbin having a small diameter, and the yarn end is not displaced from the air flow of the central hole 6. In addition, since the winding part Ya is formed at the extremity end 9*a* of the peg having a fine diameter or the head part 11*a* of the take-up tube, the above-mentioned unwinding resistance is also reduced. Then, the yarn end Y is easily blown up over the center part of the package 2 and an automatic yarn end finding of the yarn end Y of the package 2 is carried out at the winder in the same manner as that of the prior art spinning bobbin.

In order to make the action and effects of the present invention more remarkable, it may be devised that only the extremity end 9*a* of the peg 9 or the head part 11*a* of the take-up tube 11 is formed into one having a fine diameter.

The extremity end of the yarn end of the package inserted into the central hole of the peg or the bobbin is blown up with air from the lower part of the central hole, the yarn end is wound around the extremity end of the peg or the head part of the bobbin by several times, thereafter the extremity end is inserted into the peg or the central hole of the bobbin, thereby even if the winding diameter of the package is large, the yarn end is processed near the central hole, so that the yarn end is not displaced from the air flow of the central hole and then the unwinding resistance is low and the yarn is blown up. In this way, an automatic yarn finding of the package is carried out at the winder in the same manner as that of the prior art spinning bobbin.

A second embodiment of the present invention will be illustrated referring to FIGS. 10 to 14.

An apparatus of this embodiment is provided with a suction mouth for drawing a yarn end of the yarn supplying package having a yarn guide, clamp means for holding the drawn yarn end, and clamp moving means for moving the clamp means to a position where the held yarn end is engaged with the yarn guide.

With the foregoing arrangement, the suction mouth may remove the yarn end of the yarn supplying package from a surface yarn layer and draw a predetermined length of yarn. The clamp means may hold the drawn yarn. The clamp moving means causes the yarn end to be engaged with the yarn guide by moving the clamp means holding the yarn end and further enable the yarn supply package to be supplied to the automatic winder.

Figure 10:
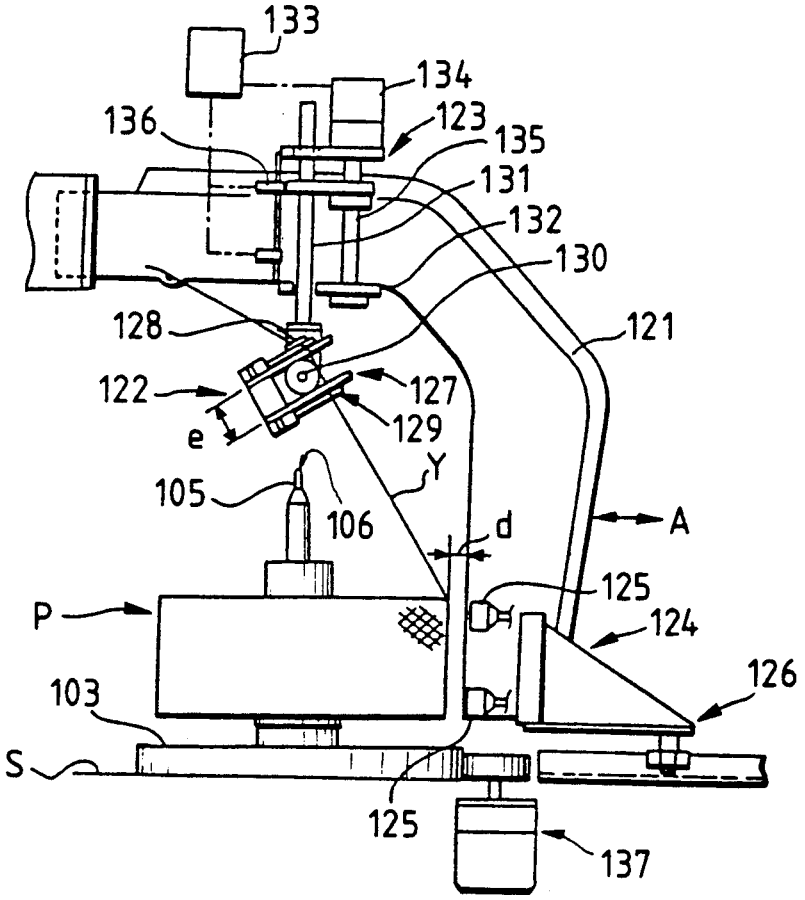
FIG. 10 is a side elevational view for showing a second preferred embodiment of an apparatus for processing yarn end constructed in accordance with the present invention.
Figure 11:
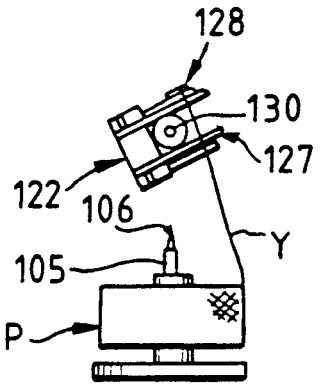
FIGS. 11 to 13 are a side elevational view for illustrating an action of an embodiment of the present invention.
Figure 12:
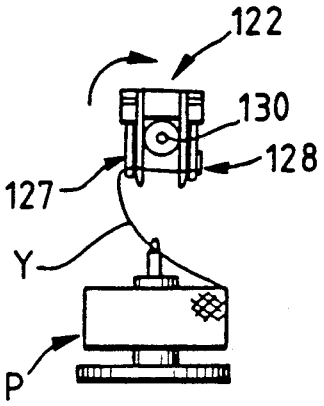
Figure 13:
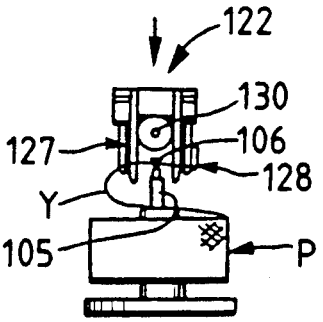

FIG. 10 illustrates one preferred embodiment of the apparatus for processing a yarn end found from a package constructed in accordance with the present invention.

The apparatus for processing the yarn end is mainly constructed by a suction mouth 121 for drawing out a yarn end Y of a yarn supplying package P having a yarn guide 105, clamp means 122 for holding the drawn yarn end Y, and clamp moving means 123 for moving the clamp means 122 to a predetermined position.

The suction mouth 121 is bent substantially at a right angle and arranged from the side to the upper part of the yarn supplying package P supplied. A slit (not shown) formed to be adjacent to the yarn supplying package P is formed inside the mouth and the yarn end Y of the yarn supplying package P is removed from the yarn layer and then drawn in an inclined upward direction.

In the preferred embodiment, the lower end 124 of the suction mouth 121 is provided with a displacement sensor 125 and a movable mechanism 126 which is cooperated with the sensor. This displacement sensor 125 is formed to inspect a distance from the surface of the yarn layer of the yarn supplying package P. When the outer diameter of the yarn supplying package P is varied, the movable mechanism 126 is driven to move in a crossing direction A of a transporting passage S of the yarn supplying package P so as to keep the distance between the suction mouth 121 and the yarn supplying package P in a predetermined distance d where the suction can be performed.

The clamp means 122 is formed by a clamp device 127 and a clamp cutter device 128 which are arranged in parallel to each other with a predetermined spacing e. The clamp device 127 and the clamp cutter device 128 have a holding part 129 for holding the yarn end Y and the yarn end Y can be held between the holding means 129 with a proper tension force. The clamp cutter device 128 may cut the upper side of the engaged yarn end Y at the holding part 129 and simultaneous with this cutting operation it may hold the yarn end Y.

The clamp moving means 123 is comprised of a horizontal rod 130 connected to the clamp means 122, and a vertical rod 131 connected to the horizontal rod 130. These rods 130 and 131 are arranged on the upper part of the suction mouth 121 so as to locate the clamp means 122 near a position (a thread path) where the yarn end Y is drawn and just over the yarn supplying package P. The clamp moving means 123 is provided with a controller 133 for cooperatively moving the horizontal rod 130 and the vertical rod 131 under a predetermined timing.

The horizontal rod 130 has a rotary motor (not shown) so as to rotate the clamp means 122 around its axis by a predetermined angle. This rotating angle is set to vary from an attitude at an initial cutting operation to another attitude in which the yarn end Y held by the clamp means 122 and in the preferred embodiment, it is rotated by about 120° only.

The vertical rod 131 is provided with a driving motor 134 for moving up or down the vertical rod 131, the screw rod 135 arranged in parallel with the vertical rod 131 is rotated in a normal direction or in a reverse direction to cause it to be moved up and down within a predetermined range. This range of moving up and moving down movement is set so as to cause the holding part 129 of the clamp means 122 to be moved from the cutting height to the extremity end of the yarn guide 105, i.e. the position where the held yarn end Y is engaged with the yarn grip 106 acting as an extremity end of the yarn guide 105.

The supporting frame 132 is provided with position sensors 136 adjacent to the vertical rod 131 with a proper spaced-apart relation so as to input the positional information of the vertical rod 131 to the controller 133.

In addition, the lower part of the suction mouth 121 is provided with a tray rotating means 137 for properly rotating the tray 103 for the yarn supplying package P and the rotating means is rotated by several time at a predetermined speed in such a way as the yarn end Y to be drawn in sequence under a suction of the suction mouth 121.

Action of this embodiment will be described.

As the yarn supplying package P is moved on the transporting path S and stopped at the position of the suction mouth 121, the suction mouth 121 may remove the yarn end Y from the yarn layer as the tray rotating means 137 is rotated, draw the yarn in an inclined upward direction so as to cause it to be engaged with the clamp means 122. At this time, the position of the suction mouth 121 is finely adjusted to enable the yarn end Y to be sucked in response to an outer diameter of the yarn supplying package P by the displacement sensor 125 and the movable mechanism 126.

The clamp device 127 of the clamp means 122 and the clamp cutter device 128 may hold the yarn end Y to cover its spacing e, cut the surplus yarn end Y so as to make a predetermined length which can be delivered to the automatic winder. Thus, the yarn end Y is held from the surface of the yarn layer of the yarn supplying package P to the substantial upper part of axis (see FIG. 11).

As the yarn end Y is held by the clamp means 122, the horizontal rod 130 is rotated by about 120° around its axis in a clockwise direction under an instruction from the controller 133. Then, the clamp means 122 may take an attitude under this rotation in which the held yarn end Y takes approximately a horizontal position (see FIG. 12).

Then, the vertical rod 131 is driven by the driving motor 134 to descend the clamp means 122. The yarn end Y held is engaged with the yarn grip 106 arranged at the extremity end of the yarn guide 105 (see FIG. 13).

As the yarn end Y is engaged with the yarn grip 106, the holding part 129 may remove the yarn end Y, the horizontal rod 130 and the vertical rod 131 are driven in an opposite direction and returned to their original attitudes. The yarn supplying package P of which yarn end Y has been processed is sent to an automatic winder, the yarn guide 105 is blown up to cause the yarn end Y to be delivered and applied to the rewinding step.

In this way, since the yarn end is automatically found and engaged with the yarn guide 105, a yarn finding process of the large sized package such as a dyeing package can be increased at its processing speed. That is, the process can be contributed to an improvement of the rewinding step.

As shown in FIG. 10, the horizontal rod 130 and the vertical rod 131 are arranged to be substantially coincided with an axis of the yarn supplying package P having a standard outer diameter. However, if an outer diameter of the yarn supplying package P is varied, the yarn end may be slightly displaced as the suction mouth 121 is adjusted and moved. In this case, this displacement is allowed within a range of a space e between the clamp device 127 and the clamp cutter device 128, so that no trouble may occur for the action of engagement. In case that the clamp means 122 is always held on an axis, it is sufficient to move the clamp moving means along the upper part of the suction mouth 121.

Figure 14:
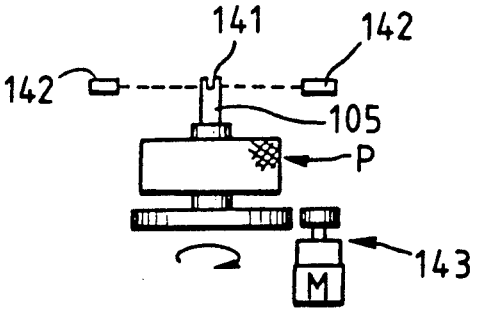
FIG. 14 is a side elevational view for showing another preferred embodiment of the present invention.

In addition of the type of "brush" of the yarn grip 106 as shown in FIG. 10, it has another type of "slit" in which an engaging direction of the yarn end Y is limited. In this case, as shown in FIG. 14, an optical sensor 142 is arranged to hold a slit type yarn grip 141 as shown in FIG. 14 to detect a direction of the yarn grip 141, the yarn supplying package P is corrected for its rotation by a tray rotating means 143 driven by the detected information so as to enable the yarn end Y to be engaged and then the yarn end may be processed. Additional constitution, act and effects of the present invention are similar to those of the embodiment shown in FIG. 10, so that the illustration and description thereof will be eliminated.

In brief, the second embodiment of the present invention has the following superior effects.

Since the apparatus of this embodiment is provided with a suction mouth for drawing out a yarn end of the yarn supplying package, clamp means for holding the drawn yarn end, clamp moving means for moving the clamp means so as to cause the yarn end to be engaged with the yarn guide, so that it is possible to speed up the yarn end processing of the large-sized package and this may contribute to an improved production of the rewinding step.

A third embodiment of the present invention will be illustrated referring to FIGS. 15 to 19.

The third embodiment provides an apparatus for processing a yarn end of a package which includes a suction mouth for drawing out a yarn end of a yarn supply package having a shaft projected along its axis, yarn end guide means for pulling the drawn-out yarn end so as to cause it to be engaged with a side part of the shaft, and package rotating means for rotating the yarn supply package around the axis in synchronous with the yarn end guide means.

With the foregoing arrangement, the suction mouth may remove the yarn end of the yarn supplying package from the yarn layer and pull it out upwardly. The yarn end guide means causes the drawn-out yarn end to be engaged with the side part of the shaft. The package rotating means causes the yarn supplying package to be rotated around its axis and the engaged yarn end to be helically wound around the peripheral surface of the shaft and then further enables the yarn end to be supplied to an automatic winder through a blowing-up operation.

Figure 15:
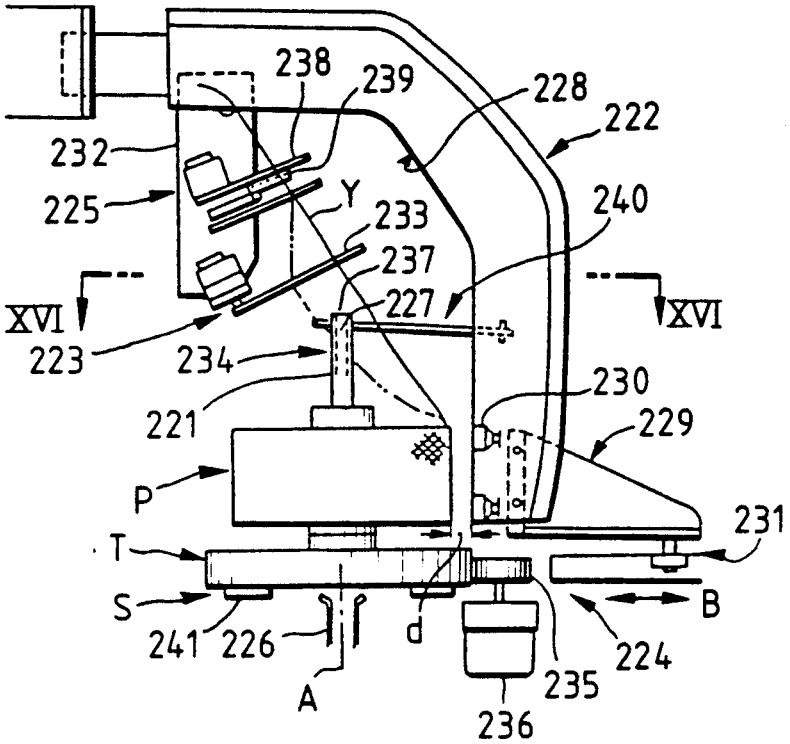
FIG. 15 is a side elevational view for showing a third preferred embodiment of the apparatus for processing the yarn end of the present invention.
Figure 16:
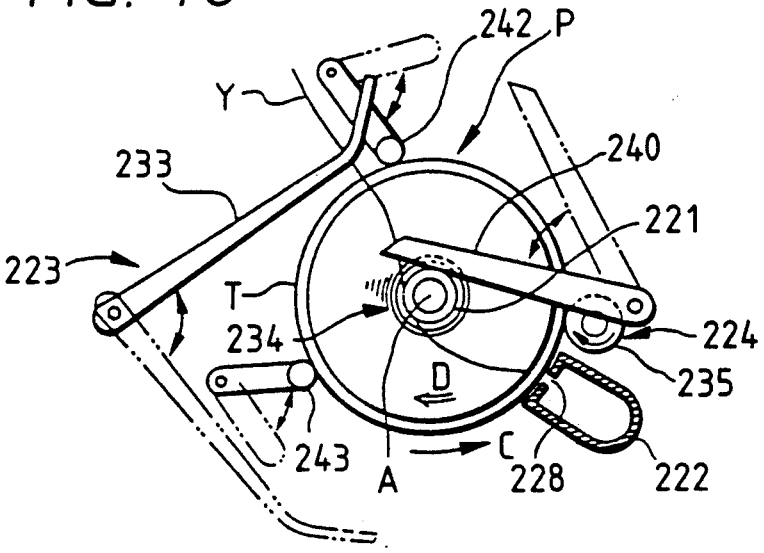
FIG. 16 is a view taken along a line XVI—XVI of FIG. 15.
Figure 17:
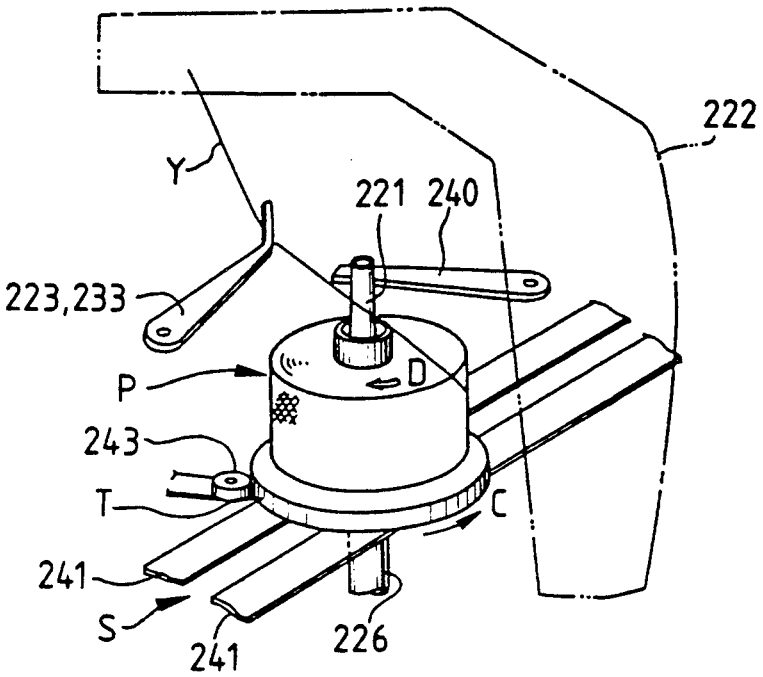
FIG. 17 is a perspective view for illustrating a substantial part of FIG. 15.

FIGS. 15 to 17 illustrate third preferred embodiment of the apparatus for processing a yarn end of the present invention.

The apparatus for processing a yarn end is constructed by a suction mouth 222 inserted and raised in a tray T having a projecting peg 221 acting as a shaft so as to draw out a yarn end Y of the yarn supplying package P, a yarn end guide means 223 for properly pulling the drawn-out yarn end Y, and package rotating means 224 for rotating the yarn supplying package P around its axis A. In addition, it is also provided with cutter means 225 for cutting the yarn end Y to a predetermined length, and a suction pipe 226 for inserting the cut yarn end Y into the projecting peg 221.

The projecting peg 221 is positioned coaxially on the axis A of the yarn supplying package P and is formed to projected above it by a predetermined length. Its central hole 227 is communicated with the lower part of the tray T.

The suction mouth 222 is substantially bent at a right angle, and arranged from the side part to the upper part of the yarn supplying package P transported on the transporting passage S. A slit 228 formed to be adjacent to the yarn supplying package P is arranged within it, the yarn end Y of the yarn supplying package P is removed from the yarn layer by suction air and then pulled out to a slant upward direction.

In the preferred embodiment, a displacement sensor 230 and a movable mechanism 231 cooperating with the displacement sensor 230 are arranged at a lower end part 229 of the suction mouth 222. This displacement sensor 230 is formed to inspect a distance from a surface of the yarn layer of the yarn supplying package P. It may act such that when an outer diameter of the yarn supplying package P is varied, the movable mechanism 231 is driven and moved to a crossing direction B of the transporting passage S of the yarn supplying package P to cause a distance between the suction mouth 222 and the yarn supplying package P to be kept at such a predetermined distance d as one capable of sucking the yarn.

The yarn end guide means 223 is kept near a thread path of the yarn end Y to be drawn through a bracket 232 at the upper part of the suction mouth 222 and has a lever member 233 arranged to be freely rotated. The lever member 233 is operated such that when it is driven to rotate, its extremity end pulls the yarn end Y to vary the thread path so as to cause it to be engaged with the side part 234 of the projecting peg 221.

Package rotating means 224 is constructed by a driving roller 235 contacted with a peripheral surface of the tray T, and a driving motor 236 for rotating the driving roller 235 in a normal or a reverse direction. The driving roller 235 is rotated in synchronous with the turning operation of the lever member 233. Its rotating direction C is opposite to a yarn winding direction D of the yarn supplying package P. That is, the yarn supplying package P is rotated by several times in such a direction as one in which the yarn end Y is wound up on the yarn layer, and winds the yarn end Y around a peripheral surface of the projecting peg 221. When the suction mouth 222 sucks the yarn end Y, the yarn supplying package P is rotated in such a direction as one in which the thread is removed (the same direction as the yarn winding direction D) and performs a yarn drawing operation.

The cutter means 225 is supported above the yarn end guide means 223 on the bracket 232 with a predetermined spacing from a top hole 237 of the projecting peg 221, and has a yarn end guide plate 238 arranged to cross with the thread path and a cutter 239 arranged between them. The yarn end Y is cut with a timing in which the yarn end Y is wound around the projecting peg 221.

A suction pipe 226 is coaxially arranged with the projecting peg 221 so as to guide the cut yarn end Y above the top hole 237 downwardly along the central hole 227 of the projecting peg 221.

In addition, there is provided a yarn stopper 240 for preventing the wound yarn end Y to be unwound. This yarn stopper 240 is made of a plate having a predetermined width and is supported at the suction mouth 222 in such a way as it may be turned in a substantial horizontal direction. It is turned when the yarn end Y is wound around the projecting peg 221 and is abutted against a peripheral surface of the projecting peg 221.

The transporting path S is formed by the two belt conveyors 241 and then the suction pipe 226 can be arranged between them. Position setting rollers 242 and 243 are arranged to hold the belt conveyors 241 therebetween in opposition to the driving roller 235. The position setting rollers 242 and 243 are rotated to abut against a peripheral surface of the tray T after the tray T transported on the transporting path S is stopped at a predetermined position.

Action of the preferred embodiment will be described.

As the yarn supplying package P is moved on the transporting path S and stopped at a predetermined position, the position setting rollers 242 and 243 are rotated to a solid line position in FIG. 16 to abut against the tray T and then rotated around the axis A by driving the package rotating means 224. The suction mouth 222 may remove the yarn end Y from the yarn layer as this rotation is carried out, pull out the yarn in a slant upward direction and then engage it with the yarn end guide plate 238 of the cutter means 225. At this time, the position of the suction mouth 222 is finely adjusted by the displacement sensor 230 and the movable mechanism 231 in response to an outer diameter of the yarn supplying package P in such a way as the yarn can be sucked.

Figure 18:
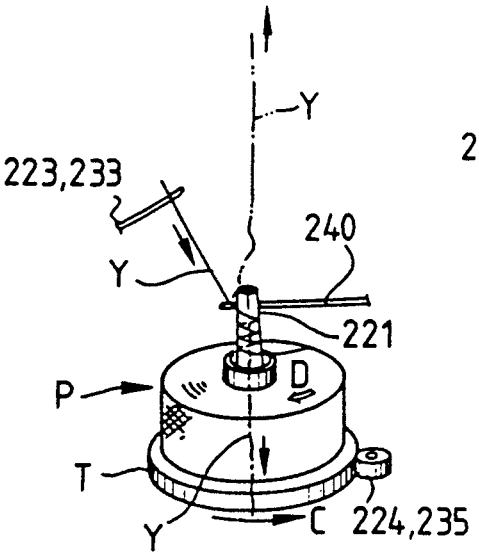
FIG. 18 is a perspective view for showing its action.

As the yarn end Y is pulled out, the yarn end guide means 223 is rotated in a counter-clockwise direction to cross with the thread path so as to cause the yarn end Y to be engaged with the side part 234 of the projecting peg 221. At this time, the driving roller 235 of the package rotating means 224 may start to rotate in a direction opposite to that of yarn finding operation. The yarn end Y is formed to be restricted at its side facing to the yarn supplying package P, form a substantial corn shape as tis rotation (in a direction C) is performed and rotated around an axis A. That is, as shown in FIG. 18, the yarn is helically wound around a peripheral surface of the projecting peg 221 while being pulled back from the upper part of the suction mouth 222.

After turning of the yarn by a predetermined number of times, the yarn stopper 240 is contacted with the upper part of the peripheral surface of the projecting peg 221 so as to shield the upper part of the wound yarn end Y from the suction mouth 222. That is, when the yarn guide means 223 is rotated up to its original position, it may prevent the wound yarn from being released by suction air directed upwardly of the suction mouth 222.

The cutter means 225 may cut the upper part of the wound yarn end Y. The suction pipe 226 may suspend the cut yarn end Y from the upper end of the top hole 237 by downward-directed air as shown in a dotted line in FIG. 18.

The yarn supplying package P of which yarn end has been processed is sent to an automatic winder. The yarn end Y is sent to a suction pipe of the automatic winder by an air flow blown upwardly within the projecting peg 221 while its winding is being released as indicated by two-dotted line in FIG. 18 and applied to the rewinding step.

All the operations for the yarn end Y are automatically carried out by the present invention and a speed-up processing of the yarn end finding of the large-sized package such as a dyeing package and the like can be accomplished. That is, the present invention may contribute to an improvement of production in a rewinding stage.

Figure 19:
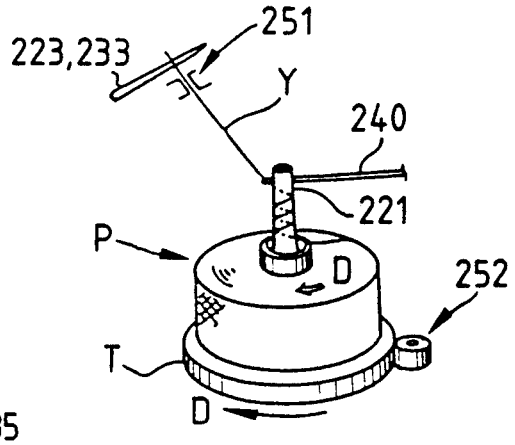
FIG. 19 is a perspective view for showing another preferred embodiment.

A rotating direction of the yarn supplying package P in case of winding the yarn onto the projecting peg 221 may be set to a direction D in which the yarn end Y is unwound as shown in FIG. 19. In this case, a mere pulling of the yarn end Y through the yarn end guide means 223 may not enable tie yarn end to be wound around t he projecting peg 221 due to a sucked state by the suction mouth 221. Due to this fact, it is necessary for the holding means 251 to be arranged at the position of the lever member 233 and to restrict the upper part of the yarn end Y. With this arrangement, the yarn end Y is wound around the projecting peg 221 while being pulled out from the yarn supplying package P. In addition, the rotation of the package rotating means 252 is sufficient in one direction to unwind the yarn end.

As the shaft projecting from the yarn supplying package P, the projecting peg 221 arranged at the tray T is not applied, but a center pipe passing through the yarn supplying package P may be separately arranged.

Further, the embodiment of the present invention can be applied to the case in which the yarn end finding operation is carried out for the yarn supplying package while the tray T being placed laterally.

In brief, according to the third embodiment of the present invention, it may have the following superior effects.

Since the apparatus of the embodiment is provided with a suction mouth for pulling out a yarn end of a yarn supplying package having a shaft, yarn end guide means for engaging the drawn end with the side part of the shaft, and package rotating means for rotating the yarn supplying package around the axis, so that the yarn end finding of the large-sized package can be conveniently accomplished and then the present invention can contribute to an improvement of a speed-up of the processing, and a productivity in the unwinding step.

Next, a fourth embodiment of the present invention will be illustrated referring to FIGS. 20 to 24.

The apparatus of fourth embodiment of present invention is comprised of a suction mouth for pulling out a yarn end of a yarn supplying package having a shaft projected along an axis, yarn end guide means for pulling the pulled-out yarn end to a side part of the shaft, and pulling means for pulling the pulled-out yarn end to a side fed out from the yarn supplying package.

With the foregoing arrangement, the suction mouth may remove the yarn end of the yarn supplying package from the yarn layer and pull out the yarn substantially in an upward direction. The yarn guide means pulls the drawn-out yarn end to a side part of the shaft and engages it with the shaft. The pulling means may pull the yarn, feeds out the yarn from the yarn supplying package, wind the yarn around a peripheral surface of the shaft to enable the yarn end to be supplied to an automatic winder through an air bowing action.

Figure 20:
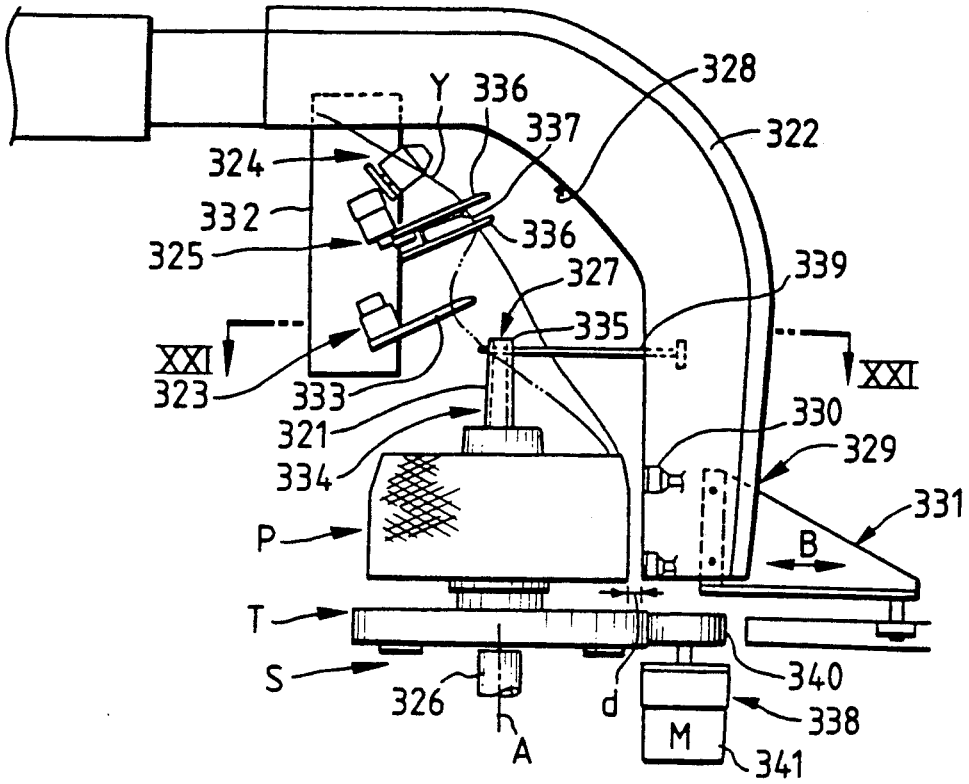
FIG. 20 is a side elevational view for showing a fourth preferred embodiment of an apparatus for processing a yarn end of the present invention.
Figure 21:
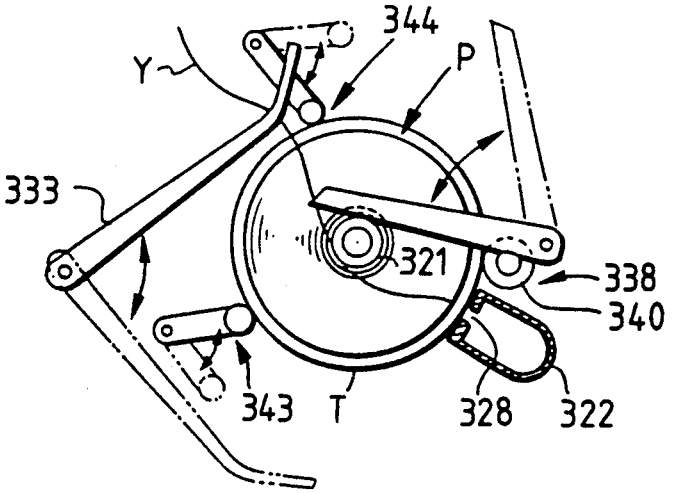
FIG. 21 is a view taken along a line XXI - XXI of FIG. 20.
Figure 22:
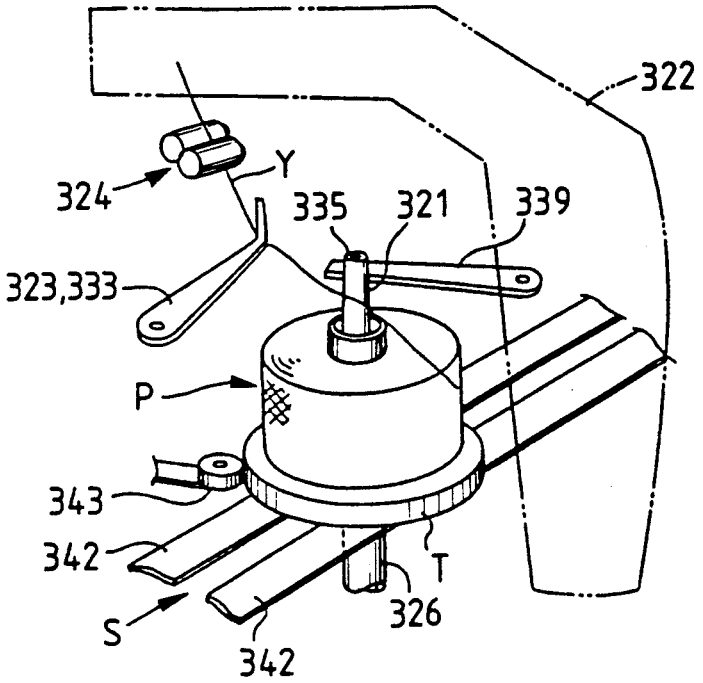
FIG. 22 is a perspective view for showing a substantial part of FIG. 20.

FIGS. 20 to 22 illustrate one preferred embodiment of the apparatus for processing a yarn end constructed in accordance with the present invention.

The apparatus for processing a yarn end is comprised of a suction mouth 322 inserted and raised at the tray T having a projecting peg 321 acting as a shaft for use in pulling out the yarn end Y of the yarn supplying package P, yarn end guide means 323 for properly pulling the drawn end Y and a nip roller 324 acting as the pulling means for pulling the pulled yarn end Y in a predetermined direction. In addition, the present invention is provided with cutter means 325 for cutting the yarn end Y to a predetermined length and a suction pipe 326 for inserting the cut yarn end Y into the projecting peg 321.

The projecting peg 321 is positioned coaxially with the axis A of the yarn supplying package P and formed to be projected by a predetermined length over it. Its central hole 327 is communicated with the central hole 327.

The suction mouth 322 is bent substantially at a right angle, and arranged from the side part of the yarn supplying package P transported on the transporting passage S to the part above it. A slit 328 formed adjacent to the yarn supplying package P is provided, the yarn end Y of the yarn supplying package P is removed from the yarn layer under an action of the suction air and then the yarn is pulled out in a slant upward direction.

In the preferred embodiment, a displacement sensor 330 and a movable mechanism 331 cooperating with the displacement sensor are provided at the lower end part 329 of the suction mouth 322. This displacement sensor 330 is formed to inspect a distance from the surface of the yarn layer of the yarn supplying package P. When the outer diameter of the yarn supplying package P is varied, the movable mechanism 331 is driven to cause it to be moved in a crossing direction B in the transporting passage S of the yarn supplying package P so as to keep a distance between the suction mouth 322 and the yarn supplying package P at a predetermined distance d where the yarn can be sucked.

The yarn end guide means 323 is held at a place near the yarn path of the pulled yarn end Y through a bracket 332 at an upper part of the suction mouth 322 and has a lever member 333 arranged to be freely rotated. The lever member 333 is constructed such that the yarn end Y is pulled by its extremity end when the lever is driven to rotate and then the thread path is varied so as to engage with the side part 334 of the projecting peg 321.

The nip roller 324 is arranged while being supported by the bracket 332 at a place near the upper thread path than the yarn end guide means 323 and constructed to hold the yarn end Y between the two rollers. These rollers are formed such that they are rotated in an opposite direction to each other around the axis crossing with the yarn path and after the lever member 333 is turned, the yarn end Y is pulled in a slant upward direction. That is, the yarn end Y is unwound from the yarn supplying package P, thereby the yarn is wound around the peripheral surface of the projecting peg 321.

The cutter means 325 is supported at the bracket 332 between the yarn end guide means 323 and the nip roller 324 with a predetermined spacing from the top hole 335 of the projecting peg 321. Further, it has yarn end guide plates 336 arranged in parallel to each other to cross the thread path and a cutter 337 arranged between the guide plates. The yarn end Y is to be cut at a timing when the yarn end Y is wound around the projecting peg 321.

The suction pipe 326 is coaxially mounted with the projecting peg 321 and guides the cut yarn end Y above the top hole 335 downwardly along the central hole 327 of the projecting peg 321.

In addition, there are provided the tray rotating means 338 for rotating the tray T around the shaft and a yarn stopper 339 for preventing the wound yarn end Y from being released.

The tray rotating means 338 is constructed by the driving roller 340 contacted with a peripheral surface of the tray T and the driving motor 341 for rotating the driving roller 340. When the suction mouth 322 may such the yarn end Y, the yarn supplying package P is rotated in such a direction as one in which the yarn end Y is to be released (the same direction as that of the yarn winding) to perform the pulling-out operation in cooperative manner.

The yarn stopper 339 is of a plate having a predetermined width and is supported by the suction mouth 322 in such a way as it may be rotated in a substantial horizontal direction. It is rotated while the yarn end Y being wound around the projecting peg 321 and it is abutted against a peripheral surface of the projecting peg 321.

The transporting path S is formed by two belt conveyors 342 and the suction pipe 326 can be arranged between the belt conveyors. Position setting rollers 343 and 344 are arranged in opposite to the driving roller 340 with the belt conveyors 342 being held. The position setting rollers 343 and 344 are rotated and abutted against the peripheral surface of the tray T after the tray T transported on the transporting path S is stopped at a predetermined position.

Action of the fourth preferred embodiment of the present invention will be described.

As the yarn supplying package P is moved on the transporting path S and stopped at a predetermined position, the position setting rollers 343 and 344 are rotated up to a solid line position shown in FIG. 21, abutted against the tray T and rotated around the shaft under a driving condition of the tray rotating means 338. The suction mouth 322 may remove the yarn end Y from the yarn layer as this rotation is carried out, pull out the yarn end in a slant upward direction to cause it to be engaged with the nip roller 324 and the yarn end guide plates 336 of the cutter means 325. At this time, the position of the suction mouth 322 is finely adjusted in response to an outer diameter of the yarn supplying package P by the displacement sensor 330 and the movable mechanism 331 in such a way as it may be sucked.

Figure 23:
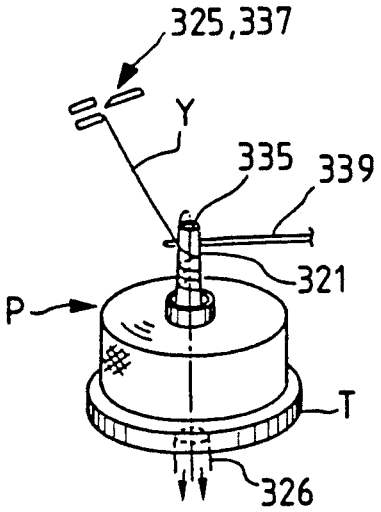
FIGS. 23 and 24 are perspective views for illustrating an action.

As the yarn end Y is pulled out, the lever member 333 of the yarn end guide means 323 is rotated in a counter clockwise direction as viewed in FIG. 21 to cross the yarn path and then the yarn end Y is engaged with the side part 334 of the projecting peg 321. At this time, the nip roller 324 may pull up the yarn in a slant upward direction so as to unwind the yarn supplying package P. That is, the yarn end Y is rotated to draw a cone-like locus while being fed out from the yarn supplying package P and as shown in FIG. 23 is wound helically around a peripheral surface of the projecting peg 321.

After the yarn is wound around by a predetermined number of times, the yarn stopper 339 is contacted with the upper part of the peripheral part of the projecting peg 321 so as to shield the upper part of the wound yarn end Y and the suction mouth 322. That is, when the lever member 333 is rotated to its original position, the wound yarn is prevented from being unwound by upward suction air of the suction mouth 322.

Then, the cutter means 325 may cut the upper part of the wound yarn end Y. The suction pipe 326 may suspend down the cut yarn end Y from the upper end of the top hole 335 by the downward directed air as indicated by a two-dotted line as viewed in FIG. 23.

Figure 24:
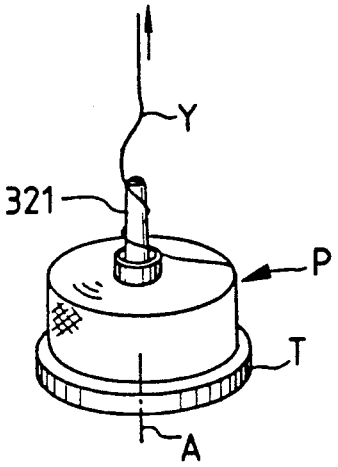

The yarn supplying package P of which yarn end Y has been processed is sent to an automatic winder. As shown in FIG. 24, the yarn end Y is sent to the suction pipe of the automatic winder along the axis A while its wound state being released by an air flow blown up within the projecting peg 321 and then supplied to the rewinding step.

In this way, the yarn end Y is wound around the projecting peg 321 and dropped down within the central hole 327, thereby the blowing-up direction of the yarn end Y can be set just above it, so that an erroneous suction is eliminated at the automatic winder.

As the shaft projected from the yarn supplying package P, the projecting peg 321 arranged at the tray T is not applied, but a center pipe passing through the yarn supplying package P is separately arranged or the take-up tube is projected upwardly so as to act as the shaft as well.

Further, the embodiment is applied to the case in which the yarn supplying package P is set laterally so as to perform a yarn end finding operation.

According to the above embodiment of the present invention, the following superior effects can be attained.

Since there are provided a suction mouth for drawing out a yarn end of a yarn supplying package having a shaft, yarn end guide means for pulling the pulled-out yarn end toward a side part of the shaft and pulling means for pulling the yarn end to a pulling side, so that a yarn end processing of a large-sized package can be conveniently performed and then the present invention can be contributed to an improved speed-up of processing and a productivity of unwinding step.

In brief, according to an embodiment of the present invention, it is possible to blow up the yarn end of the package in the winder in the same manner as that of the prior art spinning bobbin and further to perform an automatic yarn end finding.

What is claimed is:

1. A method for processing a yarn end of a package comprising the steps of:

supplying a cheese or cone type package to a winder while the package is carried on a tray;

winding the yarn end of the package around an extremity end of a peg disposed on the tray or a head part of a take-up tube of the package by several turns; and inserting the extremity end of the yarn end into a central hole of the peg or the take-up tube.

2. An apparatus for processing a yarn end the apparatus comprising:

a suction mouth for drawing out a yarn end of a yarn supplying package having a yarn guide for engaging the yarn end, clamp means for holding the drawn out yarn end, and clamp moving means for moving said clamp means up to a position where the held yarn end is engaged with said yarn guide.

3. The apparatus as claimed in claim 2, wherein said clamp means is formed by a clamp device and a clamp cutter device which are arranged in parallel to each other with a predetermined spacing, and said clamp moving means being comprised of a horizontal rod connected to the clamp means, a vertical rod connected to the horizontal rod, and a controller for cooperatively moving the horizontal rod and the vertical rod under a predetermined timing, said horizontal rod having a rotary motor so as to rotate the clamp means around its axis by a predetermined angle, and said vertical rod being provided with a driving motor for moving up or down the vertical rod.

4. An apparatus for processing a yarn end, comprising:

a suction mouth for drawing out a yarn end of a yarn supplying package having a shaft projected along its axis;

yarn end guide means for pulling the drawn-out yarn end so as to cause the yarn end to be engaged with a side part of the shaft;

package rotating means for rotating the yarn supplying package around its axis upon the yarn end being engaged with the side part of the shaft by the yarn end guide means to wind the yarn end about the shaft;

cutter means, disposed between the suction mouth and the yarn end guide means, for cutting the yarn end to a predetermined length; and a suction pipe in suction communication with the projecting shaft to suction the cut yarn end downwardly along a central hole of the projecting shaft.

5. The apparatus as claimed in claim 4, further comprising a yarn stopper for preventing the yarn end wound about the projecting shaft from being unwound, the yarn stopper being supported at the suction mouth and being turnable in a substantially horizontal direction, the yarn stopper being arranged to abut against a peripheral surface of the projecting shaft to hold the yarn end.

6. An apparatus for processing a yarn end, the apparatus comprising:

a suction mouth for drawing out a yarn end of a yarn supplying package having a shaft projected along an axis;

yarn end guide means for pulling the drawn yarn end to a side of said shaft; and pulling means for pulling the yarn end, drawn to the side of the shaft, to a side where the yarn end is fed out from said yarn supplying package.

7. The apparatus as claimed in claim 6, wherein:

the shaft is a peg of a tray on which the yarn supply package is carried out through which a central suction hole is provided; and a suction pipe is provided in communication with the central hole to suck the yarn end into the peg.

8. The apparatus as claimed in claim 6, wherein said yarn end guide means comprises a lever member arranged to be freely rotated to pull the yarn end to vary the yarn path to engage with a side part of the projecting shaft.

9. The apparatus as claimed in claim 6, wherein said pulling means comprises a pair of nip rollers for pulling the yarn end in a predetermined direction.

10. The apparatus as claimed in claim 6, wherein cutter means for cutting the yarn end to a predetermined length is further provided between the pulling means and the yarn supply package, and a yarn stopper for preventing the wound yarn end from being released is supported by the suction mouth to be rotated in a substantial horizontal direction and to be abutted against the peripheral surface of the shaft.

* * * * *